US005918321A

United States Patent [19]

Olle

[11] Patent Number: 5,918,321

[45] Date of Patent: Jul. 6, 1999

[54] DEVICE FOR FASTENING A COVER AND A SEAT TO A TOILET BOWL

[75] Inventor: Jose Estape Olle, Els Monjos, Spain

[73] Assignee: Estoli, S.A., Spain

[21] Appl. No.: 09/042,284

[22] Filed: Mar. 10, 1998

[30] Foreign Application Priority Data

Jun. 26, 1997 [ES] Spain ..... 9701766

[51] Int. Cl.[6] ..... A47K 13/26

[52] U.S. Cl. ..... 4/236; 4/234; 4/240; 16/DIG. 43; 16/249

[58] Field of Search ..... 4/236, 237, 234, 4/240, 242.1; 16/249, DIG. 43

[56] References Cited

U.S. PATENT DOCUMENTS

| | | | |
|---|---|---|---|
| 4,359,803 | 11/1982 | Lautenschlager | 16/249 X |
| 4,965,889 | 10/1990 | Tissot et al. | 4/234 |
| 4,970,731 | 11/1990 | Fait | 4/234 |
| 5,038,436 | 8/1991 | Ihrke | 16/249 |

FOREIGN PATENT DOCUMENTS

| | | | |
|---|---|---|---|
| 553065 | 5/1943 | United Kingdom | 4/234 |
| 674658 | 6/1952 | United Kingdom | 4/236 |
| 692276 | 6/1953 | United Kingdom | 4/236 |

*Primary Examiner*—Henry J. Recla
*Assistant Examiner*—Kathleen J. Prunner
*Attorney, Agent, or Firm*—Ostrolenk, Faber, Gerb & Soffen, LLP

[57] ABSTRACT

A device for fastening a toilet seat and cover to the rim of a toilet bowl, including a plate having a slot extending laterally across the plate and a screw passing through the slot. The plate is selectively adjustable along the length of the slot with respect to the screw and around the screw for positioning the plate. A stud standing up from the plate receives a hollow sleeve shaped toilet seat support over the stud. The stud is expanded by a tightening screw to secure the stud inside the support and thereby to fix the support.

6 Claims, 2 Drawing Sheets

FIG. 4a
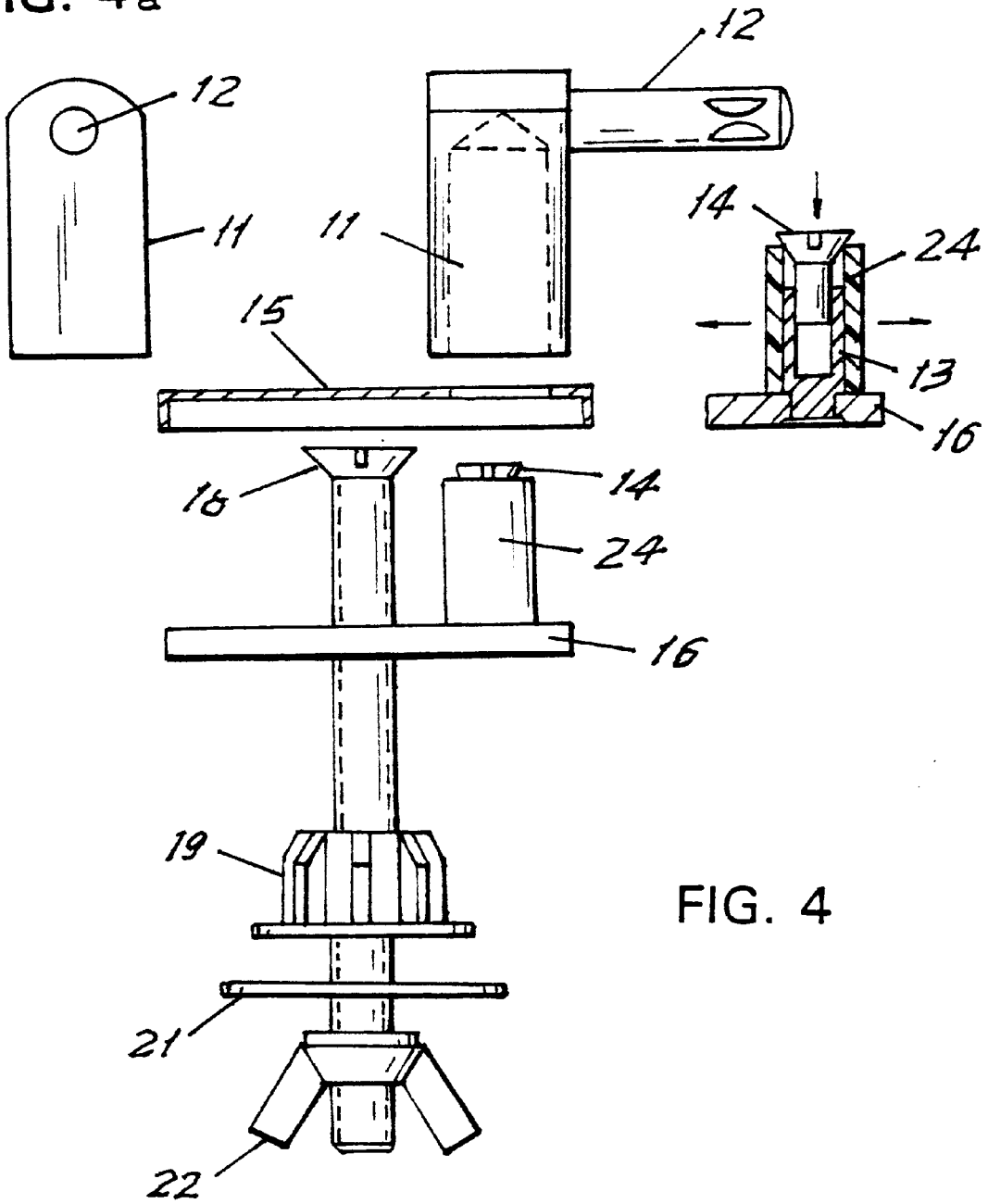
FIG. 4
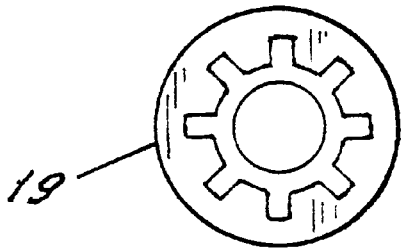
FIG. 4b

DEVICE FOR FASTENING A COVER AND A SEAT TO A TOILET BOWL

BACKGROUND OF THE INVENTION

The present invention relates to a device for fastening a cover and its seat to a toilet bowl.

Several devices exist having the aim of enabling locating and mounting a cover and a seat on a toilet bowl and, using the same standard, enabling use of covers having identical dimensions, although the distance between the holes provided in the upper rim of the bowl differs for each model of bowl.

Commercially available devices aim to allow for different distances between the holes provided in the upper rim of the bowls to be able to mount covers and seats of standard sizes and to avoid a need for a large number of different covers and seats for covering a bowl of the same upper perimeter.

Various companies manufacture toilet bowls of different types, colors, widths and heights, although it is customary that the orifices and the perimeter of the bowls are standardized. But, this does not apply to the distance between the holes that are provided for locating the devices for fixing covers and seats to the bowls. As a result, a multiplicity of devices have been developed, which purport to take account of and solve the foregoing problem while permitting rapid fixing of the device to the bowl and enabling installation of the cover and the seat without the need for much labor or special tools. Moreover, the devices seek the simplest installation position for the user, since "do-it-yourself" is customary for this installation. Users purchase a cover and seat and fit them on a toilet bowl without the assistance of other persons. A person should be able to locate the cover and the seat on a device at the bowl in a simple manner. In a single act, the device permits, not only fixing of cover and seat but also relative rotation of one with respect to the other, and of both with respect to the upper rim of the bowl.

This contrasts with other devices using the same holder, in which in the device is first fitted to the bowl and then the cover and the seat are fitted to the device, with the aid of retaining means. This is described in Spanish Utility Model No. 9,001,138 (4) concerning an improved hinge for a toilet bowl.

SUMMARY OF THE INVENTION

The present invention relates to a device for fastening a bowl cover and a toilet seat to a toilet bowl, having the objects of enabling, use of a minimum of parts and installation operations and enabling adjustment of the distance between the mounting bores or holes that are provided in the upper rim of the bowl for locating the cover and the seat.

The device comprises an adjustment plate which is fixed, using a respective screw and washer, to the holes or bores that are provided in the upper rim of the bowl. The adjustment plate has a slot which is longitudinally extended along the direction around the bowl to permit the mounting in different positions. A decoration is located on the plate. A stud projects perpendicularly up from the plane of the plate. An adjusting screw is placed in the stud. The support on the cover and seat engages the stud to be supported at the bowl. In one of its lateral bases, and perpendicular to the support for the cover and seat the support has a corresponding bolt on or pin, which serves as support element and as an axis of rotation of the cover and the seat, both with respect to the bowl and also inter se.

The slot extending along the adjustment plate permits mounting of the same cover and seat on different bowls.

Because the plate has a substantially circular base, by varying the mounting position of the plate with respect to the bowl by rotating or laterally sliding the plate, the position and orientation of the slot is changeable. This adjusts the position of the stud which projects from the plate. This makes it possible to obtain a wide range of distances between the studs and thus enables installation of virtually all the sizes and standards of covers and seats on virtually all standard bowls with standard installation hole spacings in the rim, without having to manufacture different types of plates or mounts for the same or different bowl covers and seats. It would be more expensive if it were necessary for each bowl or plate for mounting a cover and seat to require corresponding molds be available for the injection molding of each different cover and seat.

The above described adjustment plate is fastened to the upper rim of the toilet bowl by a corresponding screw and nut having an expansion washer between them which expands as a result of pressure applied by the nut. This provides a double force of immobilization of the device on the bowl, which is already arranged to locate the cover and the seat on the corresponding stud by simple pressure.

The stud is comprised of a cylindrical part of plastic or similar material through which a corresponding screw extends. Screwing the screw into a sleeve disposed inside the stud produces the expansion and bulging of the cylindrical lateral surface of the stud. When a support for the seat is mounted on the expanded stud, the expanded stud wall exerts a retaining force on the interior of the support disposed over the stud.

BRIEF DESCRIPTION OF THE DRAWINGS

FIG. 4 is an exploded view of the device.

FIG. 4*a* is a side view of the seat support.

FIG. 4*b* is a top view of an expandable base washer.

DESCRIPTION OF THE PREFERRED EMBODIMENT

Figure 1:
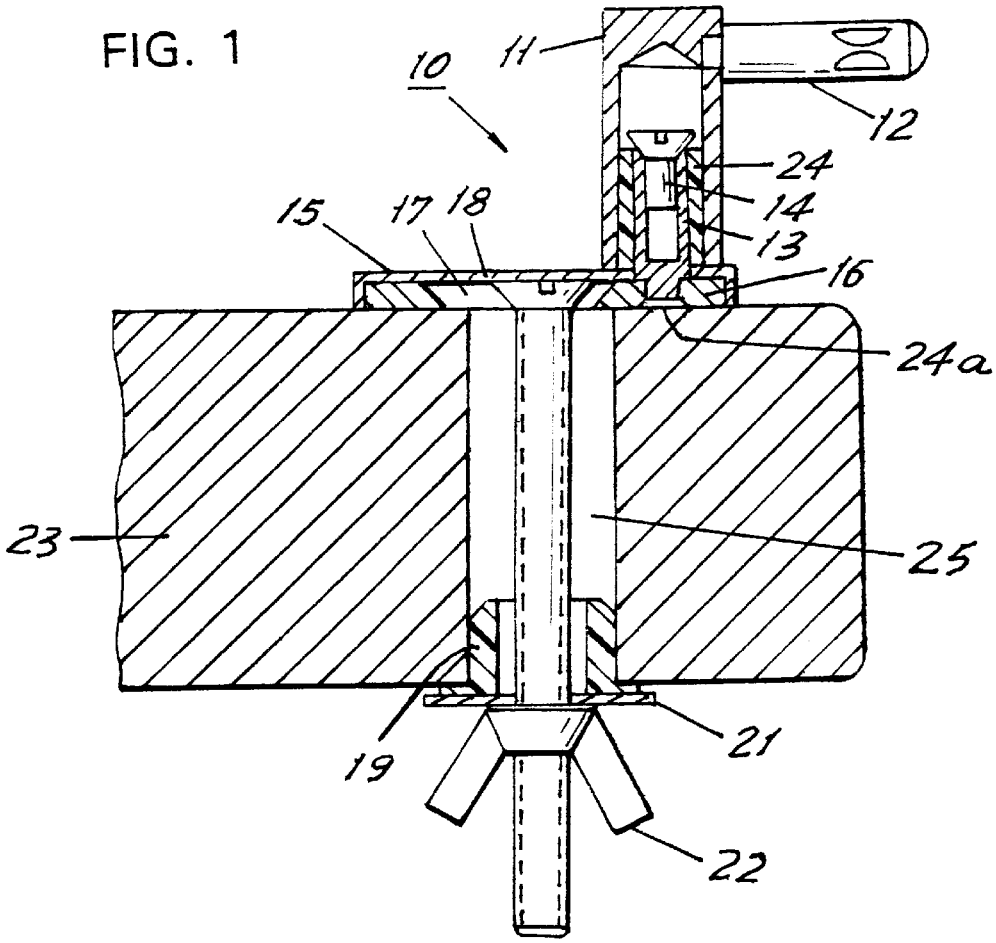
FIG. 1 is a longitudinal cross section, in front elevation, of the upper part or upper rim of a fragment of a toilet bowl on which the device of the invention has been mounted.

In FIG. 1, a toilet bowl has a rim or flange 23 at its upper perimeter which has two separated holes 25 extending through it. The differing distances between the central axes of two separated holes 25 around a rim require appropriate devices which permit fixing a cover and a seat, not shown, to a toilet bowl and which make allowance for the distance between the axes of those holes 25 and also for the relative movement of the seat and the bowl in order to be able to lower and raise the seat.

As seen in FIG. 4, the device comprises the hollow support 11 for the cover and seat, not shown. A bolt 12 projects perpendicularly laterally of the support 11. The support 11 enables rotation of the support to receive the seat and the cover, which are mounted, via corresponding lugs, on the bolt 12.

Figure 2:
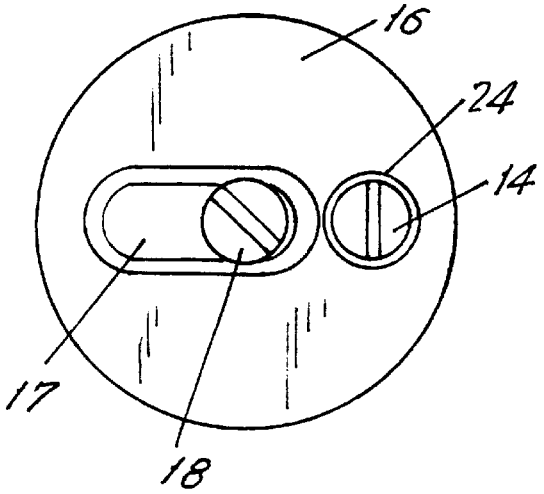
FIG. 2 is a top plan view of the adjustment plate of the device equipped with a slot and with a stud.
Figure 3:
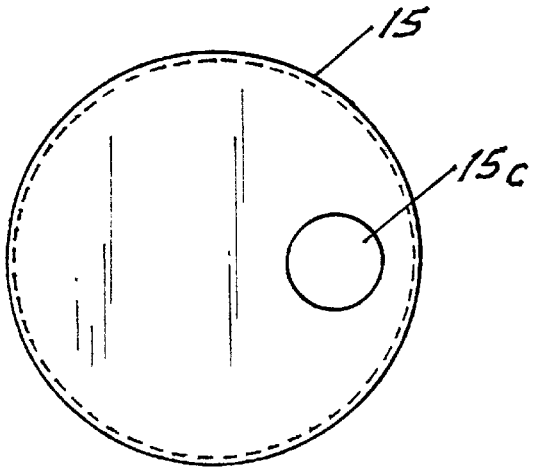
FIG. 3 is a top plan view of a decoration for the plate.

At its lower base, the support 11 encloses an internally screw threaded sleeve 13 with a bottom end that engages, as shown in FIG. 4, in an opening in an adjustment plate 16, as shown in FIG. 2. The plate 16 is substantially circular. In the central part of the plate 16 there is a slot 17 which has a long axis across the plate. The rotative orientation of the circular plate 16 around the screw 18 and the position of the plate 16 for positioning the screw 18 anywhere along the length of the slot 17 enables a broad setting of the position of the support 11 around the bowl rim.

A screw 18 is supported in the slot 17 and extends through the expansion washer 21 and the base washer 19 into the nut 22. Before the screw 18 is tightened, the rotation orientation of the plate 16 and of the support 11 on the plate around the screw 18 is adjustable. The screw 18 enables the device 10 to be fastened to the rim 23 of the bowl, with the aid of a base washer 19 which expands against the wall of the hole 25 and is held captive between the plate 16 and the washer 21 by the nut 22.

A stud 24 is positioned to be aligned in a direction across the plate with the long axis of the slot 17 and the stud 24 extends up perpendicular to the plate 16. The stud comprises a substantially cylindrical tubular part 24 of plastic or similar material which is capable of expanding under pressure that is applied to the stud 24 by the head of a screw 14 which is screwed down into the threaded sleeve 13 located inside the interior of the stud 24. The sleeve 13 is internally threaded to receive the screw 14. The sleeve 13 is held in the plate 16 by the expansion 24*a* at the bottom of the sleeve 13. Hence, as the screw 14 is tightened into the sleeve 13, its head expands the stud 24 outward as shown in dashed line in FIG. 4. The support 11 includes a hollow vertical body that is placed over the stud 24 and is oriented at the correct rotation position for supporting a cover and seat. The interior wall of the hollow support 11 is frictionally held on the stud 24 and the support may be pushed onto and lifted off the stud with application of some force.

The decoration 15 covers the device which is situated on the unobstructed upper part of the bowl, where it is located by the upper part of 16. A bore 15*c* provided in the decoration 15 is traversed by the stud 24. The decoration covers the entire device 10, and is capable of locating the bottom of the support 11, which has the function indicated above.

The slot 17 in the adjustment plate 16 permits fine adjustment and the ability to make allowance for all the possible tolerance distances between two holes 25 in a bowl rim 23. This permits the greatest application of the standards of covers and seats, as well as of toilet bowls, and avoids a need for many different types of cover, seats or bowls which would be a consequence of disparate distances between the central longitudinal axes of the holes 25 in a bowl rim.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A device for fastening a seat to a toilet bowl rim, the device comprising:

a seat support;

an adjustment plate, a slot through the adjustment plate, and a screw passing through the slot and engaging the plate for securing the plate to the toilet bowl rim, the slot having a longitudinal dimension across the plate enabling the position of the plate with respect to the screw to be selectively adjusted before the screw is tightened to secure the plate to the bowl rim;

a stud located offset on the plate from the longitudinal slot extending up from the plate including securing means on the stud for receiving the seat support;

the seat support being supported on the stud; the securing means further securing the support on the stud in a selected rotated position around the stud.

2. The device of claim 1, wherein the securing means on the stud is inside the support and comprises the stud comprising an expansible cylinder, a second screw which is tightenable with respect to the plate to expand the cylinder of the stud for retaining the orientation of the support with respect to the stud.

3. The device of claim 2, further comprising an internally threaded sleeve inside the stud and into which the second screw is tightenable, the sleeve being secured to the plate.

4. The device of claim 1, wherein the stud is aligned with the longitudinal direction of extension of the slot across the plate.

5. The device of 1, further comprising a nut for securing the screw and the plate held by the screw to the bowl rim, and a washer on the screw operable for tightening the screw in the nut for securing the screw and the plate against rotation with respect to the bowl.

6. The device of claim 1, wherein the plate is substantially circular.

* * * * *